United States Patent [19]

Scarimbolo

[11] Patent Number: 4,750,899

[45] Date of Patent: Jun. 14, 1988

[54] RANDOM ACCESS POWER ADAPTER ARRANGEMENT

[76] Inventor: John Scarimbolo, 930 Greacen Pt. Rd., Mamaroneck, N.Y. 10543

[21] Appl. No.: 774,347

[22] Filed: Sep. 10, 1985

[51] Int. Cl.[4] ..... H01R 9/22

[52] U.S. Cl. ..... 439/121; 439/94

[58] Field of Search ..... 339/20, 21 R, 21 S, 339/22 R, 22 B, 23, 24; 174/48

[56] References Cited

U.S. PATENT DOCUMENTS

| | | | |
|---|---|---|---|
| 1,955,531 | 4/1934 | Christopher | 339/21 R |
| 2,261,986 | 11/1941 | Frank . | |
| 2,348,665 | 5/1944 | Von Gehr . | |
| 2,617,849 | 11/1952 | Wright . | |
| 2,700,752 | 1/1955 | Cataldo . | |
| 2,979,686 | 4/1961 | Longmire . | |
| 3,686,613 | 8/1972 | Barski | 339/21 R |
| 3,757,273 | 9/1973 | Hesse . | |
| 3,771,097 | 11/1973 | Luxton . | |
| 3,824,522 | 7/1974 | Bertrams . | |
| 3,836,937 | 9/1974 | Donato . | |

*Primary Examiner*—Gil Weidenfeld
*Assistant Examiner*—Thomas M. Kline
*Attorney, Agent, or Firm*—Ostrolenk, Faber, Gerb & Soffen

[57] ABSTRACT

A connector is positioned at any selected location along an elongated electrical source in order to provide an electrical outlet where desired. The electrical source has a slot extending along its length, and a lengthwise extending electrical contact within the slot which is engaged by a connector contact on a contact member on the connector when the contact member is inserted in the slot. The contact member is shaped so that the connector contact is held in engagement against the lengthwise extending contact. The connector is a two-piece unit, with a contact unit including the contact member and a clamping unit which engages against the upper surface of the electrical source to hold the connector unit in a desired position. Bolts are provided to draw the clamping unit and the contact unit together to provide clamping at a desired position along the electrical source. The clamping unit includes outlets for providing electrical power to an appliance.

16 Claims, 1 Drawing Sheet

RANDOM ACCESS POWER ADAPTER ARRANGEMENT

BACKGROUND OF THE INVENTION

The present invention relates to a combination of electrical components which makes it possible to provide an electrical source at any randomly selected location within a room. More specifically, the present invention relates to a combination of a continuous power source extending along a wall and an adapter which may be positioned on the power source at any desired location.

A number of electrical systems have been proposed in which an elongated electrical source may have one or more adapters fastened along its length. U.S. Pat. No. 3,771,097 relates to an elongated power source which has three slots or grooves defined in it so that an attachment plug or adapter may be connected anywhere along the length of the receptacle. The adapter must be connected, however, by spreading apart prongs which are inserted into the slots, with each prong being in a respective slot. Therefore, if the prongs lose their resilience, the attachment may loosen and become unsatifactory. A similar arrangement is disclosed in U.S. Pat. No. 2,979,686.

U.S. Pat. No. 2,617,849 relates to another elongated power source shaped as a molding, within which an outlet is movable. In this case, however, the conductors are positioned at opposite sides of an elongated member, so that the movable outlet cannot be freely removed from the molding, but must be moved, if at all, by sliding along the length of the molding. Other similar arrangements are disclosed in U.S. Pat. Nos. 2,261,986 and 2,348,665.

U.S. Pat. No. 3,836,937 discloses another arrangement in which the positioning of the conductors prevents the adapter from being freely removable from the elongated power source. U.S. Pat. No. 3,757,273 relates to an adapter which may be clamped in a desired position, but which involves a complicated mechanical arrangement in which the contacts are moved outward in relation to the structure in which they are mounted to make contact. Other arrangements involving elongated power sources are shown in U.S. Pat. Nos. 2,700,752 and 3,824,522.

It would be advantageous to provide an arrangement including an elongated power source and an adapter in which the adapter could be freely removable from the power source or, alternatively, may be moved to a desired location by sliding without a complicated mechanical structure for moving the contacts. It would furthermore be advantageous to provide such an arrangement in which the position of the adapter along the elongated power source could be made as secure as desired, and in which an extremely high level of safety is maintained.

SUMMARY OF THE INVENTION

The present invention provides an arrangement including an elongated electrical source and an adapter which may be freely positioned along the length of the electrical source, either by sliding or by removing the adapter and repositioning it in another location, all without a complicated mechanical structure for moving the contacts in relation to the body of the adapter. The present invention further provides an arrangement in which the positioning of the adapter along the electrical source may be made as secure as desired, and in which the danger of electrical shock is minimized.

An electrical system according to the present invention includes an elongated electrical source or power bar which has a lengthwise extending slot in it. Lengthwise extending electrical contacts are on the interior surface of the electrical source facing the slot.

According to one aspect of the present invention, a connector which connects to the electrical source has a contact member which is shaped to fit into the slot and which has connector contacts on it for engaging the lengthwise extending contacts. The contact member can be inserted into and removed from the slot at any of a plurality of points along its length or may be moved by sliding, and the connector also includes clamping means which clamp the connector to the electrical source at a selected point along its length. The facing side of the slot and the opposite side of the contact member may be substantially parallel and spaced apart such that the contact member is slightly thinner than the width of the slot. A connector contact on one side of the contact member is positioned to engage a lengthwise extending contact on one side of the slot and the opposite sides of the slot and the contact member engage in order to hold the contacts against each other. In addition, the slot extends toward an exterior clamping surface on the electrical source so that when the connector clamping means applies pressure to the exterior clamping surface, the contact member is held in the slot and the connector is clamped onto the electrical source.

The connector may include both a contact unit which fits into the slot and a clamping unit which engages the electrical source, with the clamping means drawing the contact unit and the clamping unit together. This functions to clamp the connector to the electrical source with the contact unit in the slot at a selected point along its length.

The present invention thus makes it possible to remove the contact unit from the slot or, alternatively, to slide it along the slot when it is desired to change its position. It is unnecessary to adjust the positions of the contacts themselves, in order to perform these steps, since the contacts need not be pulled apart in order to slide the connector or adapter, and the contacts are positioned so that they will be pulled apart when the connector is removed from the slot for repositioning.

Other objects, features and advantages of the invention will be apparent from the following description, together with the accompanying drawings and the appended claims.

DETAILED DESCRIPTION OF THE PREFERRED EMBODIMENTS

Figure 1:
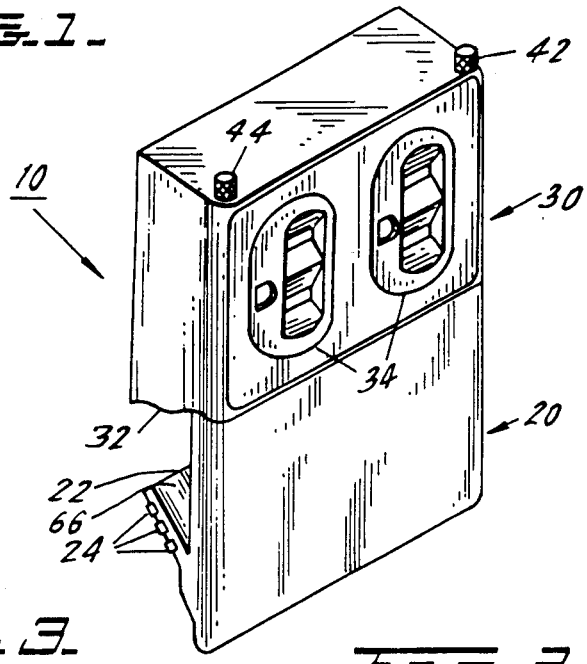
FIG. 1 is a perspective side view of a connector or adapter according to the present invention.

FIG. 1 shows a connector or adapter according to the present invention in perspective. Connector 10 includes contact unit 20 and clamping unit 30. As shown in FIG. 1, contact unit 20 and clamping unit 30 are structured so that their front surfaces are substantially in a plane, and connector 10 is constructed so that it does not extend further than this plane into a room in which it is being used, reducing the likelihood of accidental damage to connector 10.

Contact unit 20 includes contact member 22 which extends obliquely upward and toward the rear of connector 10. On one of the opposite spaced apart sides of contact member 22, connector contacts 24 are positioned. Except for these contacts 24 and for the necessary circuitry connecting them to other electrical components, the remainder of contact unit 20 is preferably made of insulating material, and may be, for example, a lightweight and durable plastic material. Preferably, connector contacts 24 or contact member 22 will be slightly resilient or springy to facilitate connection.

Clamping unit 30 is above contact unit 20, but has a clamping surface 32 on its lower side generally toward contact member 22. Clamping unit 30 also includes outlets 34 which are connected by appropriate circuitry to connector contacts 24 and may be used to provide electrical power to an electrically powered appliance. Like contact unit 20, the remainder of clamping unit 30 is preferably insulating material.

FIG. 1 also shows the clamping means which serves to clamp connector 10 in place. These clamping means are bolts 42 and 44 which have heads which may be manually turned in order to tighten or loosen the clamping connection. Any other suitable clamping means could be used.

Figure 2:
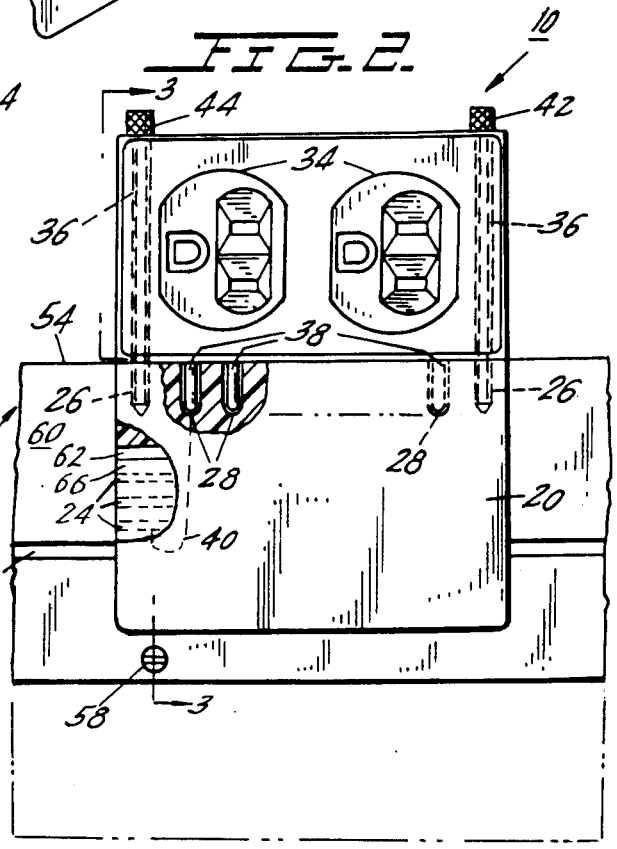
FIG. 2 is a partial cutaway view showing the connector of FIG. 1 in the slot of an elongated electrical source according to the present invention.

FIG. 2 shows in more detail the clamping means, showing how contact unit 20 has threaded sleeves 26 defined therein for receiving the ends of bolts 42 and 44. Clamping unit 30 similarly has sleeves 36 defined therein through which bolts 42 and 44 extend. In order to provide an electrical connection between connector contacts 243 and outlets 34, contact unit 20 includes female plugs 28, while clamping unit 30 includes male plugs 38, the plugs 28 and 38 being structured to ensure an electrical connection in spite of slight variations in the tightness of the clamping bolts 42 and 44. Also shown schematically is wiring 40 from female plug 28 to connector contact 24.

As shown in FIG. 2, connector 10 is clamped onto an elongated electrical source 50, also referred to as a power bar. Electrical source 50 may extend along an entire wall of a room or, with appropriate corner units, may extend around the entire perimeter of a room. Therefore, connector 10 may be moved and repositioned at any selected position along the length of slot 52 defined in an exterior surface 60 of electrical source 50. On the upper side of electrical source 50 is an exterior clamping surface 54 which engages the clamping surface 32 of clamping unit 30, as can be seen more clearly in FIG. 3.

Figure 3:
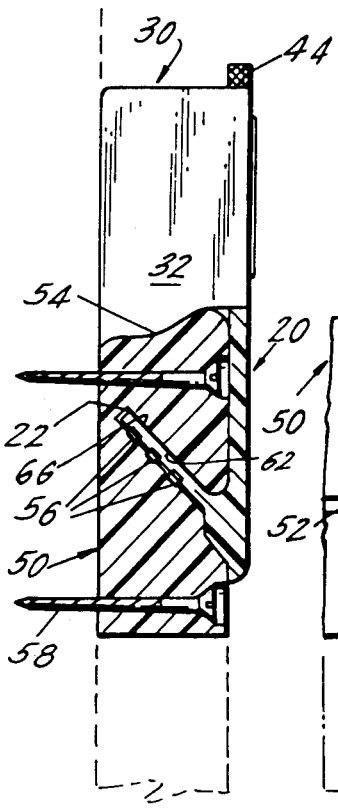
FIG. 3 is a partial cross-sectional view of the connector and electrical source of FIG. 2 taken along the line 3—3.

FIG. 3 is a partial cross-sectional view which shows in greater detail the clamping arrangement of the present invention. As can be seen, electrical source 50 has a lengthwise extending electrical contact 56 on one of the facing sides of an interior surface 62 disposed toward slot 52. Therefore, when contact member 22 is inserted into slot 52, connector contacts 24 are positioned to engage lengthwise extending contacts 56, providing power to engage lengthwise extending contacts 56, providing power to outlet 34. As shown, the contacts must be spaced apart so that connector contacts 24 cannot provide a short circuit between adjacent ones of lengthwise extending contact 56. Furthermore, the opposite side of slot 52 engages a contact clamping surface 66 of contact member 22, helping to hold each connector contact 24 against a respective lengthwise extending contact 56. Also, as noted above, the contacts 24 and 56 or contact member 22 may be resilient to make the insertion and removal of contact member 22 easier.

When contact member 22 is in slot 52 as shown in FIG. 3, connector 10 may be secured in a desired position by tightening clamping bolts 42 and 44. This will cause clamping unit 30 to be drawn together with contact unit 20, and will also cause clamping surface 32 to engage exterior clamping surface 54 on electrical source 52, so that the downward facing surface within slot 50 also is pressed against the upward facing contact clamping surface 66 of contact member 22 to clamp connector 10 in place. The shaping of contact member 22 so that it extends upward ensures that the connector 10 will be securely clamped in position.

FIG. 3 also shows screws 58 holding electrical source 50 against a wall, and electrical source 50 will preferably be positioned just above a baseboard on the wall, as shown in FIG. 3. In this manner, the risk of damage is minimized, and an electrical source of maximum flexibililty is provided with minimal inconvenience.

Connector 10 and electrical source 50 may both be constructed of any appropriate insulating material, except for the parts which are electrically conductive. In order to provide maximum strength, it may also be desirable that the clamping means be metal, but the clamping means must in that case be completely insulated from the electrical circuitry.

Although connector 10 has been illustrated as having outlets 34, the connector 10 could be used for a variety of other purposes. If outlets like those shown are employed, however, it is preferable for them to be positioned in clamping unit 30, to minimize the profile of connector 10. It would also be possible to provide a switch on connector 10, and connector 10 could alternatively be equipped to provide a connection to any other type of electrical equipment, including a telephone, a television, or a computer terminal. Electrical source 50, rather than providing only conventional electrical power could be a signal source for a telephone, computer or cable television signal, in which case connector 10 could be equipped with an appropriate outlet.

In the embodiment of FIG. 3, contact between the upper contact clamping surface of contact member 22 and the adjacent surface in the interior of electrical source 50 holds the contacts against each other, but alternative means could be used such as springs or nubs on either surface to maintain the necessary engagement of the contacts.

In order to assure safety, slot 50 may be made sufficiently small that human fingers cannot be inserted into it. Contact unit 20 may telescope into clamping unit 30, and the female plugs 28 may be arranged so that they cannot be touched even though contact unit 20 may be in slot 52.

In general, the system of the present invention may be used for individual rooms or for entire homes or buildings, whether new or existing construction. The electrical source, the power bar, may be made in sections which snap together and are permanently mounted on a wall at any convenient height. End caps may be provided to make connections at the corners of a room, and each end cap may have a junction box with appropriate fuses. More than one circuit may be provided in a single room, with separate circuit breakers to prevent overload. When the electrical source is in position, one or more connectors, or adapters, may be positioned as needed around the room.

The system according to the invention eliminates the need for unsightly and cumbersome extension cords and also eliminates the need for additional wiring. Wall switches may be provided as desired to control the operation of the power bars making up the electrical source. The tightening of the bolts which provide the clamping of the connectors can be sufficient to ensure the same level of safety as a conventional wall outlet. Because the conductive elements are enclosed within a slot in the electrical source, the electrical source may be painted or cleaned without danger of electrical contact.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An electrical system comprising:

an elongated electrical source strip extending in a lengthwise direction, the source strip having an exterior surface with a lengthwise extending slot defined therein, said source strip further having an interior slot surface which extends inwardly into the slot from the exterior surface, and also at least one lengthwise extending electrical contact on the interior slot surface;

a connector for connecting to the electrical source strip, the connector having a contact member shaped to fit into the slot and further shaped for being inserted into and removed from the slot at any of a plurality of points along the length of the slot and for being moved by sliding along the slot;

at least one connector contact on the contact member for engaging with the lengthwise extending electrical contact when the contact member is in the slot;

the contact member having an unclamped position and a clamped position, such that in the clamped position, the contact member is in clamped engagement with the interior slot surface, and in the unclamped position, the contact member in the slot is not clamped to the interior slot surface; and the connector further having clamping means for clamping the connector to the electrical source strip with the contact member in the slot;

the electrical source strip having an exterior clamping surface, the interior slot surface being shaped so that the contact member extends generally toward the exterior clamping surface as it extends into the slot in the electrical source strip, the clamping means applying pressure to the exterior clamping surface to hold the contact member in the clamped position.

2. The system of claim 1 in which the connector has an electrical outlet therein for connecting to an electrically powered appliance.

3. The system of claim 1 in which the interior slot surface has spaced apart first and second facing side surfaces, the contact member having spaced apart first and second opposite contact member side surfaces, the spacing between the first and second facing side surfaces of the interior slot surface and the first and second contact member side surface permitting the contact member to be inserted into and removed from the slot.

4. The system of claim 3 in which the first and second facing side surfaces of the interior slot surface are substantially parallel and spaced apart by a first distance, the first and second contact member side surfaces being substantially parallel and spaced apart by a second distance slightly shorter than the first distance.

5. The system of claim 3 in which at least one of the following, namely the contact member, the connector contact, and the electrical contact, is resilient for facilitating movement of the connector contact over the electrical contact during the insertion and removal of the contact member.

6. The system of claim 3 in which the lengthwise extending electrical contact is on the first facing side surface of the interior slot surface, the connector contact being on the first contact member side surface and positioned to engage the lengthwise extending contact when the contact member is in the slot, the second contact member side surface engaging the second facing side surface to hold the contacts in engagement.

7. The system of claim 1 in which the contact member includes a clamping surface which is in clamped engagement with the interior slot surface when the clamping means applies pressure for clamping the connector onto the electrical source strip.

8. The system of claim 7 in which the clamping surface of the contact member further engages the interior slot surface for holding the connector contact in engagement with the length-wise extending electrical contact.

9. The system of claim 1 in which the connector further comprises a clamping unit having a connector clamping surface for engaging the exterior clamping surface of the electrical source strip, wherein the clamping means, the clamping surfaces and the contact member cooperate in the clamped position to clamp the connector to the electrical source strip.

10. The system of claim 9 in which the clamping unit of the connector has an electrical outlet therein for connecting to an electrically powered appliance, the connector further comprising circuitry for connecting the connector contact to the outlet.

11. The system of claim 1 in which the exterior clamping surface of the electrical source strip and the exterior surface of the electrical surface strip are adjacent surfaces.

12. The system of claim 1 in which the contact member presses directly against the interior slot surface of the electrical source strip when in the clamped position.

13. An electrical system comprising:

an elongated electrical source strip extending in a lengthwise direction, the source strip having an exterior clamping surface, a second exterior surface with a lengthwise extending slot defined therein, and an interior slot surface which extends inwardly into the slot from the second exterior surface and also having at least one lengthwise extending electrical contact on the interior slot surface;

a connector for connecting to the electrical source strip, the connector comprising a contact member for fitting into the slot and, attached to the contact member, a clamping unit for engaging the exterior clamping surface of the electrical source strip;

the contact member being shaped for being inserted into and removed from the slot at any of a plurality of points along the length of the slot, the contact member further having a contact clamping surface for engaging the interior slot surface;

at least one connector contact on the contact member for engaging the lengthwise extending contact in the slot when the contact unit is in the slot; and the connector further comprising clamping means for drawing the contact member and the clamping unit together to clamp the clamping unit against the exterior clamping surface of the electrical source strip and to clamp the contact clamping surface of the contact member against the interior slot surface of the electrical source strip, and thereby clamp the connector to the electrical source strip with the contact member in the slot at a selected point along the length of the slot;

in which the interior slot surface is shaped so that the contact member extends generally toward the exterior clamping surface as it extends into the slot in the electrical source strip, the clamping means applying pressure to the exterior clamping surface and to the interior slot surface to hold the contact member in the slot.

14. The system of claim 13 in which the contact clamping surface further engages the interior slot surface for holding the connector contact in engagement with the lengthwise extending contact.

15. The system of claim 13 in which the clamping unit has an electrical outlet defined therein for connecting to an electrically powered appliance, the connector further comprising circuitry for connecting the connector contact to the outlet.

16. The system of claim 13 in which the exterior clamping surface of the electrical source strip and the second exterior surface of the electrical source strip are adjacent surfaces.

* * * * *